US006942458B2

(12) United States Patent
McCallum et al.

(10) Patent No.: US 6,942,458 B2
(45) Date of Patent: Sep. 13, 2005

(54) VARIABLE PITCH FAN

(75) Inventors: Jonathan E. McCallum, Edmonton (CA); Terry D. Nelson, Edmonton (CA); Murray C. Gerwing, Edmonton (CA)

(73) Assignee: Flexxaire Manufacturing Inc., Edmonton (CA)

( * ) Notice: Subject to any disclaimer, the term of this patent is extended or adjusted under 35 U.S.C. 154(b) by 50 days.

(21) Appl. No.: 10/265,135

(22) Filed: Oct. 7, 2002

(65) Prior Publication Data

US 2004/0067135 A1 Apr. 8, 2004

(51) Int. Cl.[7] ..... F01D 7/00
(52) U.S. Cl. ..... 416/157 R; 416/139
(58) Field of Search ..... 416/157 R, 155, 416/139, 162–4, 175, 44–48, 168 R

(56) References Cited

U.S. PATENT DOCUMENTS

| | | | | | |
|---|---|---|---|---|---|
| 3,217,808 | A | | 11/1965 | Elmer | 170/160.16 |
| 3,501,251 | A | | 3/1970 | Haglund et al. | 416/157 |
| 4,037,986 | A | * | 7/1977 | Chilman | 416/46 |
| 4,221,541 | A | | 9/1980 | Bianchi | 416/157 R |
| 5,122,034 | A | | 6/1992 | Isert | 416/167 |
| 5,161,953 | A | * | 11/1992 | Burtis | 416/242 |
| 5,174,718 | A | * | 12/1992 | Lampeter et al. | 416/48 |
| 5,282,719 | A | * | 2/1994 | McCarty et al. | 416/1 |
| 5,299,911 | A | | 4/1994 | Moriya | 416/35 |
| 5,501,576 | A | * | 3/1996 | Monroe | 416/239 |
| 5,836,743 | A | * | 11/1998 | Carvalho et al. | 416/139 |
| 6,109,871 | A | * | 8/2000 | Nelson et al. | 416/36 |
| 6,113,351 | A | * | 9/2000 | Mccallum et al. | 416/48 |
| 6,129,528 | A | * | 10/2000 | Bradbury et al. | 417/423.1 |
| 6,190,126 | B1 | | 2/2001 | Haegele et al. | |
| 6,253,716 | B1 | * | 7/2001 | Palmer et al. | 123/41.12 |
| 6,352,407 | B2 | | 3/2002 | Hill et al. | 416/144 |
| 6,378,322 | B1 | * | 4/2002 | Calvert | 62/314 |

FOREIGN PATENT DOCUMENTS

| | | |
|---|---|---|
| EP | 0 945 626 A2 | 9/1999 |
| GB | 1114934 | 5/1968 |
| WO | WO98/44242 | 10/1998 |
| WO | WO99/20522 | 4/1999 |

* cited by examiner

*Primary Examiner*—Edward K. Look
*Assistant Examiner*—James M. McAleenan

(57) ABSTRACT

An improved variable pitch fan comprising a fan hub, with fan blades extending radially outward from the fan hub and mounted for rotation about respective radially extending axes corresponding to each fan blade. Each fan blade has a blade surface extending perpendicularly to the radially extending axis of the fan blade, each blade surface lying between respective outer edges of the corresponding fan blade and facing rearward. A pitch shifting mechanism is mounted in the hub and interconnects with the fan blades to control the rotational position of each fan blade about the corresponding radially extending axis of the fan blade. The respective outer edges of each fan blade diverge as the fan blade extends further radially outward; and the blade surface of each fan blade has an angle of attack that decreases as the fan blade extends radially outward. Each blade surface has a constant or increasing radius of curvature as the respective fan blade extends further radially outward. The respective outer edges of each fan blade are straight. Each fan blade has integral moulded counterweight supports and counterweights mounted on the counterweight supports.

12 Claims, 5 Drawing Sheets

VARIABLE PITCH FAN

BACKGROUND OF THE INVENTION

This invention relates to the design of variable pitch fans used on engines, particularly heavy machinery.

The design of a variable pitch fan involves a number of difficult design challenges. First, there is the problem of obtaining high performance without sacrificing high efficiency in converting energy into air flow. Since the energy required to move air is a function of the square of the air velocity, the theoretically most efficient way to move the air is to develop a flat velocity profile across the fan. This keeps the velocity of the air near the center of the hub the same as at the outer edges. Because the blades are rotating, the velocity of the blade increases away from the center of rotation. Therefore in order to maintain a flat velocity profile (the axial velocity of the air across the fan diameter), the fan designer needs to increase the pitch and the section (size of the cross section) of the blade near the center where the blade is moving slowly. At the perimeter, there are much higher speeds, and so the fan has similar performance with a smaller, less pitched profile. The conventional twist and taper of variable pitch fan blades in which the fan blades have smaller cross-section further radially outward gives the best efficiency in terms of moving a certain volume of air with the least horsepower, but limits performance in terms of moving enough air. Spinning faster to gain more air movement results in high tip speeds, but high tip speeds create structural problems and create noise that may exceed environmental guidelines. A further requirement for the fan blades is the need for a narrow swath. In a variable pitch fan, increase of the pitch of the fan blades results in the fan blades cutting a wider swath through the air. Hence, it is preferred to have narrow blades. On the other hand, it is known to be desirable to have a high solidity ratio, defined as the width of the outside perimeter of the blades divided by the total outside perimeter, since this provides higher performance in terms of total air flow.

Other problems faced in the design of variable pitch fans include design of easily detachable blades, reducing the size of the pitch shifting mechanism while maintaining stability of the pitch shifting mechanism and mounting counterweights on the fan blades.

SUMMARY OF THE INVENTION

The present invention provides a fan with high solidity ratio, good performance, with minimal reduction in efficiency. In addition, the present invention provides easily detachable blades, and a reduced size while maintaining stability of the pitch shifting mechanism.

There is therefore provided an improved variable pitch fan comprising a fan hub, with fan blades extending radially outward from the fan hub and mounted for rotation about respective radially extending axes corresponding to each fan blade. Each fan blade has a blade surface extending perpendicularly to the radially extending axis of the fan blade, each blade surface lying between respective outer edges of the corresponding fan blade and facing rearward. A pitch shifting mechanism is mounted in the hub and interconnects with the fan blades to control the rotational position of each fan blade about the corresponding radially extending axis of the fan blade.

In one aspect of the invention, the respective outer edges of each fan blade diverge as the fan blade extends further radially outward; and the blade surface of each fan blade has an angle of attack that decreases as the fan blade extends radially outward. The fan blades preferably taper inward over the greater portion of their length.

In other aspects of the invention that assist in improving performance and the structural strength and stability of the fan: each blade surface has a constant or increasing radius of curvature as the respective fan blade extends further radially outward; and the respective outer edges of each fan blade are straight. In other aspects of improved construction of the fan, each fan blade has integral moulded counterweight supports and counterweights mounted on the counterweight supports; each fan blade is mounted on a shaft and secured on the shaft by clamping two sections of the fan blade onto the shaft; and one of the two sections of the fan blade is smaller than the other. To improve stability of the pitch shifting mechanism, the fan hub has interior walls defining a cylinder having an axis, the interior walls including an encircling wall and first and second end walls and the pitch shifting mechanism includes a piston that is stabilized within the fan hub by contact of an outer peripheral sealed surface of the piston with the encircling wall and by a guide interconnecting the piston and one of the first and second end walls. To further improve stability of the pitch shifting mechanism, other aspects of the invention include the guide extending from the piston through one of the first and second end walls and the guide lying along the axis of the cylinder. In still further improvements, the piston is actuated by fluid injected through a port lying on the axis of the cylinder; contact between the piston and the encircling wall occurs at the outer peripheral sealed surface and at an inner peripheral surface of the piston; and the inner peripheral surface of the piston is coincident with inward edges of blade mounts for the fan blades.

These and other aspects of the invention are described in the detailed description of the invention and claimed in the claims that follow.

BRIEF DESCRIPTION OF THE DRAWINGS

There will now be described preferred embodiments of the invention, with reference to the drawings, by way of illustration only and not with the intention of limiting the scope of the invention, in which like numerals denote like elements and in which.

DETAILED DESCRIPTION OF PREFERRED EMBODIMENTS

In this patent document, the word comprising" is used in its non-limiting sense to mean that items following the word in the sentence are included and that items not specifically mentioned are not excluded. The use of the indefinite article "a" in the claims before an element means that one of the elements is specified, but does not specifically exclude others of the elements being present, unless the context clearly requires that there be one and only one of the elements. When the word "mounted" is used, the item referred to may be mounted directly or indirectly on the object on which the item is mounted.

Figure 1:
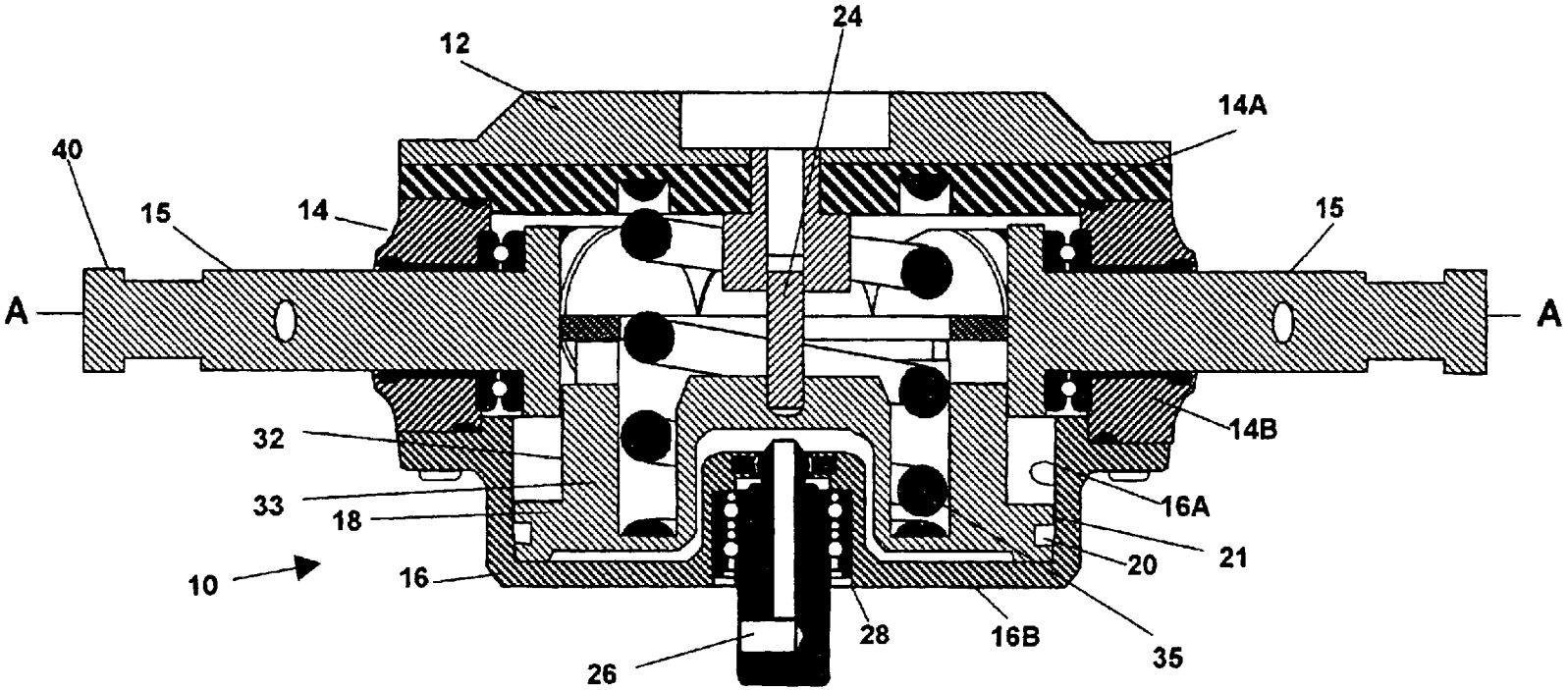
FIG. 1 is a section through a reversible pitch fan according to the invention.
Figure 2:
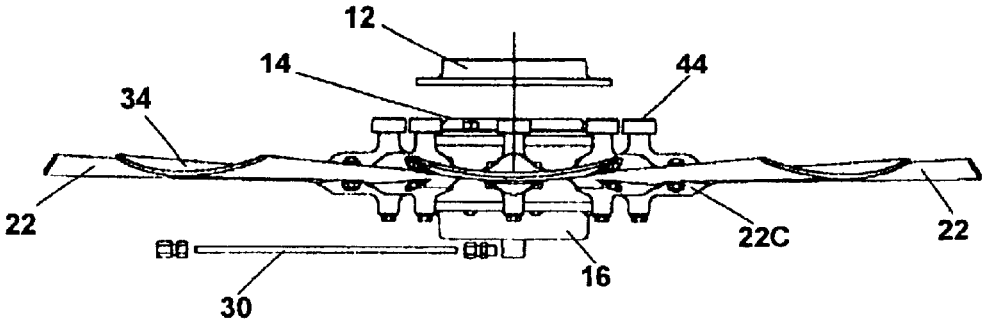
FIG. 2 is a side view of the fan of FIG. 1 with the fan blades in neutral position.
Figure 3:
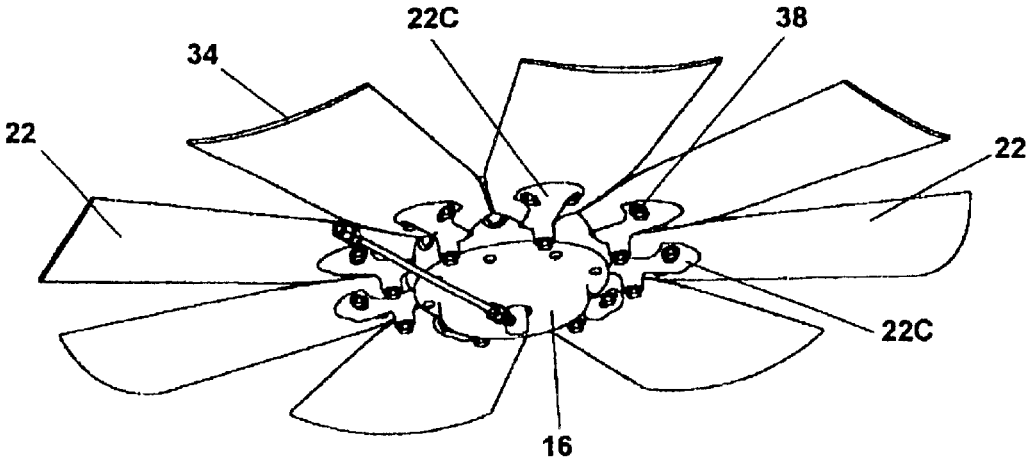
FIG. 3 is a first perspective view of the fan of FIG. 1 with the fan blades in neutral position.
Figure 4:
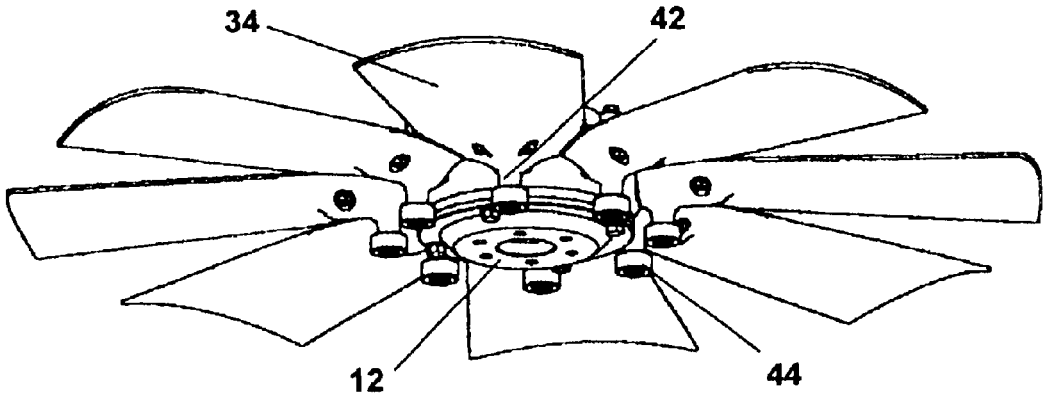
FIG. 4 is a second perspective view of the fan of FIG. 1 with the fan blades in neutral position.
Figure 5:
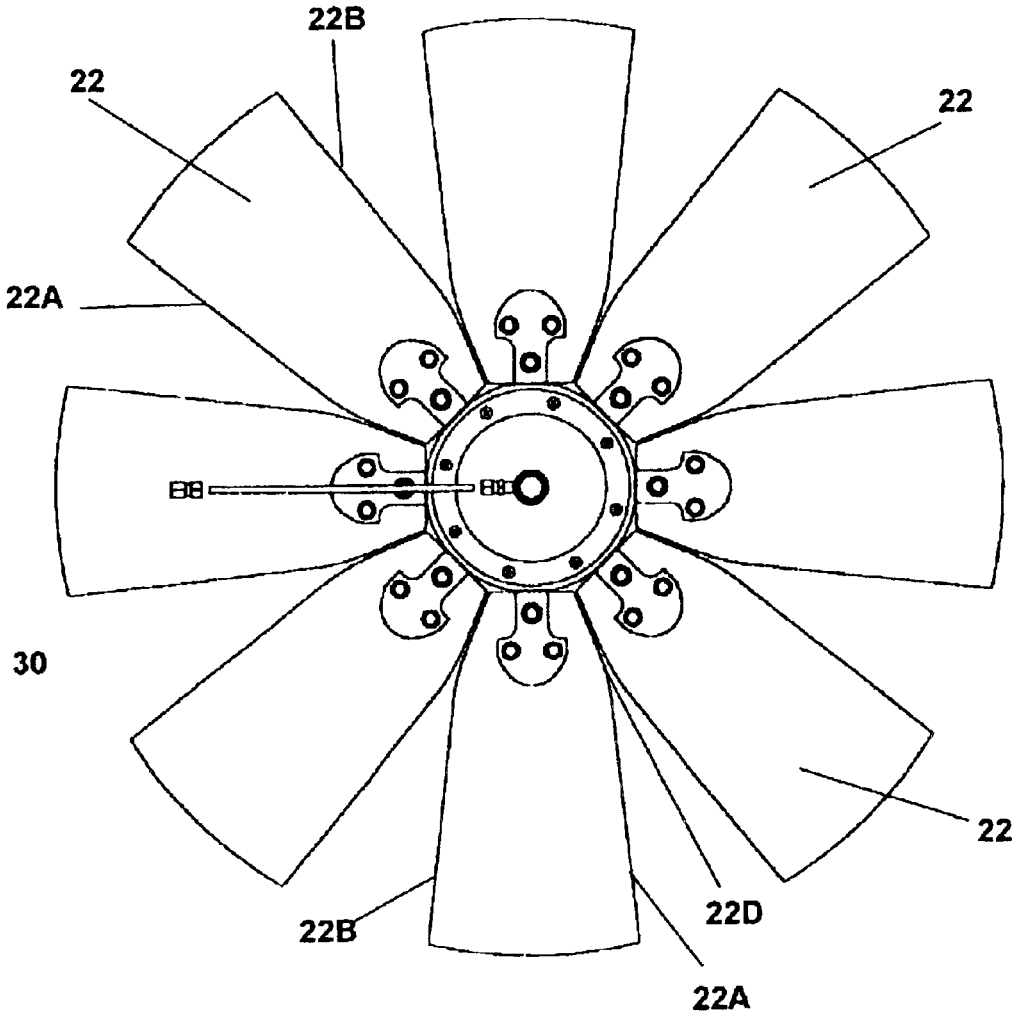
FIG. 5 is a plan view of the fan of FIG. 1 with the fan blades in neutral position.
Figure 6:
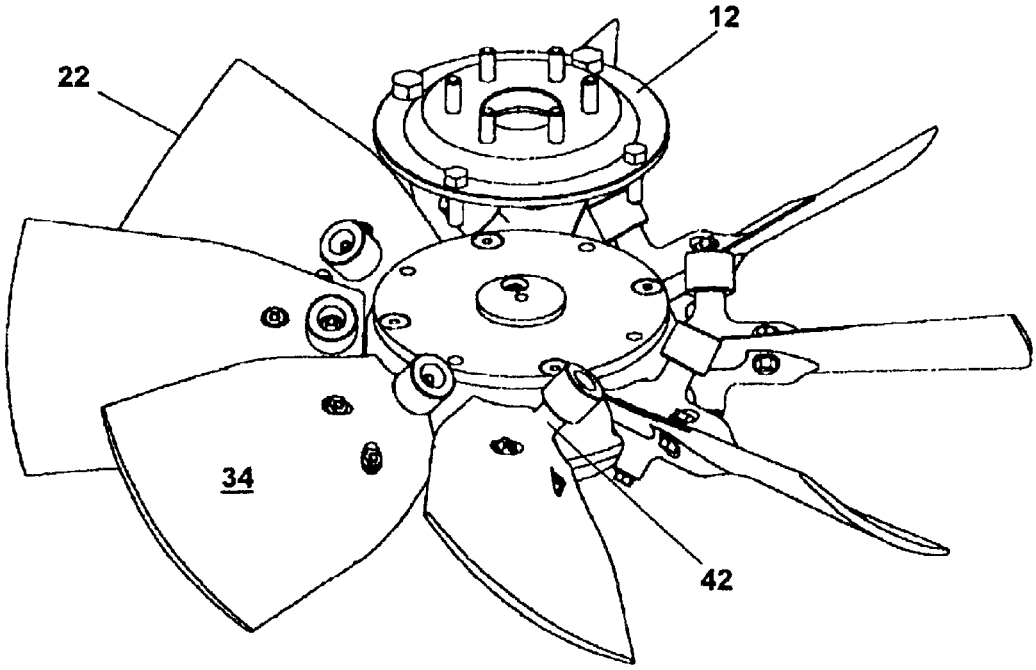
FIG. 6 is a side perspective view of the fan of FIG. 1 with the fan blades in normal working position.
Figure 7:
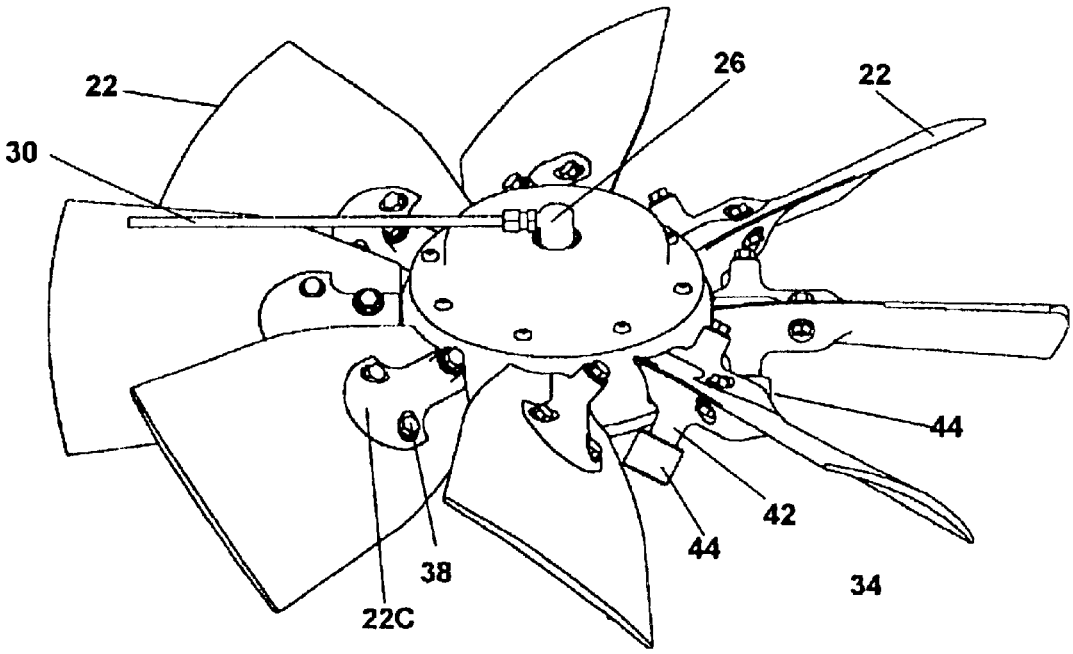
FIG. 7 is a first perspective view of the fan of FIG. 1 with the fan blades in normal working position.

Referring to FIG. 1, a variable pitch fan has a fan hub 10 formed of a mounting plate 12, a rear housing 14 and front housing 16. Rear housing 14 has a disc shaped end portion or back plate 14A to which the mounting plate 12 is attached, and a cylindrical portion 14B in which is formed circumferentially spaced openings for receiving blade mounts 15. Front housing 16 is secured to the rear housing 14 as for example by bolts to form a cylindrical hub cavity. The cylindrical hub cavity is bounded radially within the front housing 16 by a cylindrical wall 16A of the front housing 16, and axially by the end wall 14A and wall 16B of the front housing 16. The cylindrical hub cavity is bounded circumferentially by the wall 16A and an inner surface of the wall 14B, with the walls 16A and 14B together forming an encircling wall of the hub cavity.

A piston 18 is held within the hub cavity, with a sealed peripheral edge 21 of the piston 18 sealed against the encircling wall 16A using a seal (not shown) in seal groove 20. The piston 18 forms part of a pitch shifting mechanism for shifting the pitch of fan blades 22 mounted on the blade mounts 15. The piston 18 is stabilized within the fan hub 10 by contact of the outer peripheral sealed surface 20 of the piston with the encircling wall 16A and by a guide pin 24 that interconnects the piston 18 and the end wall 14A. The guide pin 24 preferably extends along the central axis of the fan hub 10 and is secured to the piston 18, while being able to slide through a central opening in the end wall 14A. The piston 18 is actuated by fluid, preferably air, injected through a port 26 lying on the axis of the fan hub 10. The port 26 is mounted on bearing 28 to allow rotation of the fan hub 10 while the port 26 remains stationary and connected through a line 30 to a supply of air, not shown. Preferably, to enhance stabilization of the piston 18, while maintaining a maximum cavity width, contact between the piston 18 and the encircling wall formed of walls 16A and 14B occurs at the outer peripheral sealed surface 20 and at an inner peripheral surface 32 on an annular extension 33 of the piston 18. The inner peripheral surface 32 of the piston 18 defines the maximum inner extent of the blade mounts 15, thereby maximizing blade length and piston surface while minimizing fan width. In operation, the inner peripheral surface 32 and the inner extent of the blade mounts 15 are provided with a small clearance of about 1/32 inches. Action of the piston 18 is opposed by a spring 35 held between end face 14A and end face 16B.

Figure 8:
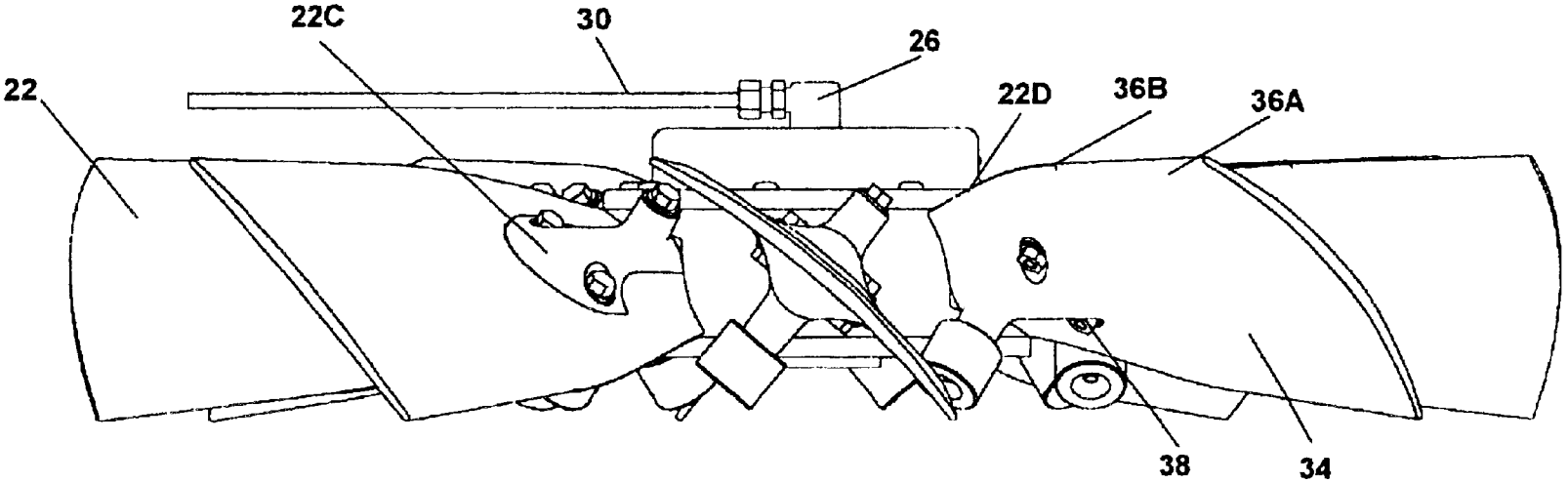
FIG. 8 is a second side perspective view of the fan of FIG. 1 with the fan blades in normal working position.

The fan blades 22 extend radially outward from the fan hub 10 and are mounted for rotation about respective radially extending axes A corresponding to each fan blade 22. Each fan blade 22 has a blade surface 34 extending perpendicularly to the radially extending axis A of the fan blade 22. Each blade surface 34 lies between respective outer edges 22A and 22B of the corresponding fan blade 22 and faces rearward (towards element 12) for a sucker fan, and forward (fan blades rotated 180 degrees) towards port 26 for a blower fan. The blade shafts 15 are also rotated 180 degrees for a blower fan so that the default position is the main operating position. Movement of the piston 18 in the fan hub 10 controls the rotational position of each fan blade 22 about the corresponding radially extending axis A of the fan blade 22 by interconnecting of the piston extension 33 with stubs (not shown) on the blade mounts 15 that are offset from the axis A. The respective outer edges 22A and 22B of each fan blade 22 diverge as the fan blade 22 extends further radially outward. This results in a blade that tapers radially inward. Preferably, the taper extends over the greater proportion of the fan blade length. Each fan blade surface 34 is preferably cylindrical with constant radius or conical with decreasing radius of curvature closer to the hub 10, such that the blade surface 34 of each fan blade 22 has an angle of attack that decreases as the fan blade 22 extends radially outward. The decreasing angle of attack can be seen in FIG. 8, with outer blade portion 36A having a lower angle of attack (pitch) than inner blade portion 36B. The respective outer edges 22A and 22B of each fan blade 22 are preferably straight for a significant portion of their length, at least 80%. As used in this patent document, angle of attack means the angle of the leading edge of the blade as it cuts through air. The angle of the whole blade section (obtained by laying a straight edge on the blade) is constant for the blades described here even though the angle the leading edge makes with the air changes along the blade.

Each fan blade 22 is preferably secured to the blade mounts 15 using a clamp formed of the main blade section 22 and smaller blade section 22C. The blade sections 22 and 22C are preferably individually moulded and clamped by bolts 38 around ends 40 of the blade mounts 15 (ends 40 are seen best in FIG. 1). Each fan blade 22 is also preferably provided with integral moulded counterweight supports 42 on which are mounted counterweights 44. Counterweights can be mounted on either 22 or 22C with similar results, and counterweights may also be mounted on both surfaces, thus reducing the size of an individual weight.

The counterweights 44 are mounted on each fan blade 22 in a position which generates a torque opposite in direction to torque generated by the fan blades 22. Each fan blade 22 has a chord and the counterweights 44 are mounted perpendicular to the chord on at least one side of the fan blade 22. The weight of the counterweights 44 may be selected to underbalance, balance or overbalance the blades 22. Due to the shape of a fan blade 22, the centrifugal forces produced when the fan hub 10 spins generates a torque on the fan blades 22 which tends to force the fan blades 22 to a neutral pitch. This force increases with the square of the RPM and is related to the shape and mass of the blade according to known principles in the art of making aircraft propeller blades. By varying the size and placement of the counterweights, the weights may be underbalanced, balanced, or overbalanced, corresponding to whether the torque generated by the counterweights is less than, equal to or greater than the torque generated by the blades. In the underbalanced condition, there is a net torque driving the blades to neutral pitch and in the overbalanced condition, there is a net torque driving the blades to full pitch.

The use of the counterweights depends on the operation of the pitch shifting mechanism. In a hydraulic design such as described in U.S. Pat. No. 6,113,351, a double acting cylinder is used that can be stroked either way hydraulically. This design makes use of the naturally occurring neutral pitch in the underbalanced condition, or the overbalanced position of keeping the fan in full pitch. In the underbalanced condition, the counterweights reduce the force required to hold the blades in full pitch, but at the same time keep the weights below the balance point, so that the blades default to neutral pitch. This is useful for open loop control systems. Without sensors, neutral pitch is unattainable if the blades are balanced or overbalanced. By keeping the blades underbalanced, neutral pitch can be achieved simply by removing positioning control and letting the blades rotate freely. In hydraulic applications, this is achieved simply by equalizing the pressure on each side of the piston. A simple control system can then achieve full pitch in either direction depending on which side of the piston receives the high pressure fluid, and can achieve neutral pitch by equalizing the pressure on each side of the piston, i.e. by using simple valving. In the balanced condition, the force required to hold the blades in any pitch can be dropped effectively to zero. Balanced blades require the lowest pitch adjustment forces, and thus smaller components, and in the case of hydraulic systems, lower operating pressure. In the overbalanced condition, the blades drive into pitch. This is advantageous in that the fan then defaults to full pitch in case of shifter mechanism failure. For the hydraulic fan, if a leak occurred or hydraulic pressure failed, the fan defaults to full pitch and a potential over heat condition can be avoided.

In the preferred embodiment of the fan described in detail here, spring 35 keeps the fan in the default position of full pitch, while the pitch shifting mechanism is used to urge the fan blades into neutral or reverse pitch. In this case, the counterweights 44 are used to minimize centrifugal effects of the blade to approximate a linear response of blade pitch to control pressure. Preferably, the blades are balanced.

Spring 35 is preferably a fairly stiff spring, and may have a spring constant in the order of 750 to 2100 lbs/inch. Multiple springs may be used distributed around the fan hub, as for example 10×75 lb/in springs. An inward end 22D of the fan blades 22 is angled inward to allow for clearance between the fan blades 22 near the hub, while maintaining a high solidity ratio and constant air flow across the fan. The effective spring constant of the spring may be altered by use of counterweights. When a spring with spring constant of 800 lb/in is used, the spring may be pre-loaded in the full pitch condition with a force of 600 lb. With a travel of 1 inch to the neutral position, the force required to maintain the blades in the neutral position is 1400 lb. If the blades are underbalanced using counterweights, the fan blades, depending on rotation speed, and acting through the pitch shifting mechanism, may exert an axial force of for example 400 lb in the full pitch position. Consequently, the air pressure required to overcome the spring force to move away from full pitch is 200 lb. In the neutral position, regardless of whether the fan blades are balanced, underbalanced or overbalanced, the force required to hold the neutral position remains 1400 lb. Since the axial travel of the spring from full pitch to neutral remains 1 inch, an effective spring constant of 1200 lb/in is obtained. Thus, a higher effective spring constant may be obtained by underbalancing the blades. This effect is dependent on the rpm of the blades in full pitch, and might be used in constant rpm applications.

A person skilled in the art could make immaterial modifications to the invention described in this patent document without departing from the essence of the invention.

What is claimed is:

1. A variable pitch fan, comprising:

a fan hub;

fan blades extending radially outward from the fan hub and mounted for rotation about a radially extending axis corresponding to each fan blade, each fan blade having a blade surface extending perpendicularly to the radially extending axis of the fan blade, the blade surface lying between respective outer edges of the corresponding fan blade;

a pitch shifting mechanism mounted in the hub and interconnecting with the fan blades to control the rotational position of each fan blade about the corresponding radially extending axis of the fan blade;

each fan blade having an integral moulded counterweight support and a counterweight mounted on the counterweight support; and each fan blade is mounted on a shaft and secured on the shaft by clamping two sections of the fan blade onto the shaft, with one of the two sections of the fan blade incorporating the counterweight support.

2. The variable pitch fan of claim 1 in which one at the two sections of the fan blade is smaller than the other of the two sections.

3. A variable pitch fan, comprising:

a fan hub;

fan blades extending radially outward from the fan hub and mounted for rotation about a radially extending axis corresponding to each fan blade, each fan blade having a blade surface extending perpendicularly to the radially extending axis of the fan blade, the blade surface lying between respective outer edges of the corresponding fan blade;

a pitch shifting mechanism mounted in the hub and interconnecting with the fan blades to control the rotational position of each fan blade about the corresponding radially extending axis of the fan blade; and each fan blade being mounted on a shaft and secured on the shaft by clamping two sections of the fan blade onto the shaft.

4. The variable pitch fan of claim 3 in which one of the two sections of the fan blade is smaller than the other and further comprising counterweight supports moulded onto at least one of the two sections, counterweights being mounted on the counterweight supports.

5. A variable pitch fan, comprising:

a fan hub having interior walls defining a cylinder having an axis, the interior walls including an encircling wall and first and second end walls;

fan blades extending radially outward from the fan hub and mounted for rotation about a radially extending axis corresponding to each fan blade;

a pitch shifting mechanism mounted in the hub and interconnecting with the fan blades to control the rotational position of each fan blade about the corresponding radially extending axis of the fan blade; and the pitch shifting mechanism including a piston that is stabilized within the fan hub by contact of an outer peripheral sealed surface of the piston with the encircling wall and by a guide interconnecting the piston and one of the first and second end walls.

6. The variable pitch fan of claim 5 in which the guide extends from the piston through one of the first and second end walls.

7. The variable pitch fan of claim 6 in which the guide lies along the axis of the cylinder.

8. The variable pitch fan of claim 7 in which the piston is actuated by fluid injected through a port lying on the axis of the cylinder.

9. The variable pitch fan of claim 5 in which contact between the piston and the encircling wall occurs at the outer peripheral sealed surface and at an inner peripheral surface of the piston.

10. The variable pitch fan of claim 9 in which the inner peripheral surface of the piston is coincident with inward edges of blade mounts for the fan blades.

11. A variable pitch fan, comprising:

a fan hub having interior walls defining a cylinder having an axis, the interior walls including an encircling wall and first and second end walls;

fan blades extending radially outward from the fan hub and mounted for rotation about a radially extending axis corresponding to each fan blade;

a pitch shifting mechanism mounted in the hub and interconnecting with the fan blades to control the rotational position of each fan blade about the corresponding radially extending axis of the fan blade; and the pitch shifting mechanism including a piston that is stabilized within the fan hub by contact of an outer peripheral sealed surface of the piston with the encircling wall and by contact between the piston and the encircling wall at an inner peripheral surface of the piston.

12. The variable pitch fan of claim 11 in which the inner peripheral surface of the piston is coincident with inward edges of blade mounts for the fan blades.

* * * * *